United States Patent [19]

Farenholtz .

[11] Patent Number: 5,050,872

[45] Date of Patent: Sep. 24, 1991

[54] EXERCISE AND TRAINING APPARATUS

[76] Inventor: Douglas W. Farenholtz, 5409-45th Avenue, Delta British Columbia, Canada, V4K 1L3

[21] Appl. No.: 495,125

[22] Filed: Mar. 19, 1990

Related U.S. Application Data

[63] Continuation-in-part of Ser. No. 341,353, Apr. 21, 1989, Pat. No. 4,951,943.

[51] Int. Cl.[5] ..... A63B 21/00

[52] U.S. Cl. ..... 272/134; 272/118

[58] Field of Search ..... 272/117, 118, 123, 134, 272/136, 142, 143, DIG. 4, 901, 67

[56] References Cited

U.S. PATENT DOCUMENTS

| | | | |
|---|---|---|---|
| 89,047 | 3/1869 | Lawrence . | |
| 1,861,012 | 5/1932 | Hornbeck et al. . | |
| 3,072,400 | 1/1963 | Dykinga | 272/118 |
| 3,438,627 | 4/1969 | Lanne . | |
| 3,464,696 | 9/1969 | Hooker . | |
| 3,649,016 | 3/1972 | Kelly . | |
| 3,659,847 | 5/1972 | Gow . | |
| 3,851,874 | 12/1974 | Wilkin . | |
| 3,942,796 | 3/1976 | Bowen . | |
| 4,063,727 | 12/1977 | Hall | 272/136 |
| 4,068,843 | 1/1978 | Frost | 272/118 |
| 4,149,714 | 4/1979 | Lambert, Jr. . | |
| 4,154,441 | 5/1979 | Gajda . | |
| 4,209,167 | 6/1980 | Jansen | 272/901 X |
| 4,373,717 | 2/1983 | Lambert, Jr. . | |
| 4,402,504 | 9/1983 | Christian . | |
| 4,422,636 | 12/1983 | De Angeli . | |
| 4,441,706 | 4/1984 | Korzaniewski . | |
| 4,600,188 | 7/1986 | Bangerter et al. . | |
| 4,603,855 | 8/1986 | Sebelle . | |
| 4,632,388 | 12/1986 | Schleffendorf . | |
| 4,720,103 | 1/1988 | Palladino . | |
| 4,721,303 | 1/1988 | Fitzpatrick | 272/118 |
| 4,799,671 | 1/1989 | Hoggan et al. . | |
| 4,826,157 | 5/1989 | Fitzpatrick | 272/134 |
| 4,842,270 | 6/1989 | Lange . | |
| 4,898,381 | 2/1990 | Gordon | 272/117 |

FOREIGN PATENT DOCUMENTS

| | | | |
|---|---|---|---|
| 2541574 | 4/1984 | France . | |
| 604340 | 3/1960 | Italy | 272/67 |
| 2184953 | 7/1987 | United Kingdom . | |

*Primary Examiner*—Robert Bahr

*Attorney, Agent, or Firm*—Shlesinger, Arkwright & Garvey

[57] ABSTRACT

A training and exercise device for applying a force against a resisting force, such as a weight stack, includes an upstanding frame, a rotatable arm supported by the frame at a first end for rotation about the frame in a horizontal plane and a force receiving device communicating with the arm for receiving force applied by a user. The force receiving device is longitudinally slidable along the arm to cause force to be applied against the resisting force when the force receiving device is pushed horizontally along the arms towards the frame. A cable connects the force receiving device to the resisting force and is attached at a first end to the resisting force. A grasping device is attached to the second end of the cable. The force receiving device includes a pair of handles which may be rotated about an axis perpendicular to the longitudinal horizontal axis of the arm. Optionally the arm may be connected to the resisting force which returns the arm to a pre-determined normal position when the arm is released. As a further option, the outer end of the arm may be rotatable with respect to the inner end of the arm, about a longitudinal horizontal axis of the arm. The outer end of the arm is returnable to a pre-determined normal position upon release of force against the arm. Optionally, an "A" frame attachment having a pulley at the apex thereof may extend from the bottom of the frame. A cable extends through the pulley and may be pulled upwardly and outwardly to cause force to be applied against the resisting force. A treadmill may be attached to the frame to permit the user to move on the treadmill while applying force on the device.

27 Claims, 12 Drawing Sheets

EXERCISE AND TRAINING APPARATUS

This is a continuation-in-part of application Ser. No. 07/341,353 filed Apr. 21, 1989, now U.S. Pat. No. 4,951,943.

BACKGROUND OF THE INVENTION

The present invention relates generally to an exercise testing and training apparatus and, more particularly, to a training apparatus which is rotatable about a horizontal plane to permit the application of force by a user, in any direction with respect to the apparatus and which permits both pushing and pulling forces to be simultaneously applied against a resisting force.

Training or exercising equipment used to develop muscle strength and which are used to test the relative strength of individuals, are well known. Such equipment usually consists of a mechanism by which the user can apply force against a resisting force contained in the apparatus. Commonly, a user applies force against a specific gripping or force receiving mechanism, which is connected to a cable. The cable is, in turn, connected, by means of one or more pulleys, to a specific weight or other force resisting means. When force is applied on the gripping means, the weight is lifted. Alternatively, the weight may be replaced by a spring, or pneumatic cylinders which provide a resisting force when force is applied on the gripping mechanism by the user.

Most of these prior art training or exercise devices provide a relatively specific orientation of the gripping or force receiving mechanism. There is no provision for moving such gripping means in a horizontal plane to permit application of force by the user in a variety of positions about the exercise machine. See for example U.S. Pat. No. 4,632,388 issued to Schleffendorf which requires the user to orient himself opposite rigid arm 16 in order to properly use the exercising system disclosed. The Schleffendorf device does not provide for use of the device by the user while positioned in a variety of positions around the circumference of the device.

A further example of such an exercise machine is disclosed in U.S. Pat. No. 4,441,706 issued to Korzaniewski. A rigidly positioned arm 26 extends outwardly from the frame requiring the user to stand opposite this arm in order to use the device.

It is also desirable, at times, to use such exercising and training devices by applying both pushing and pulling force, either alternatively, or simultaneously, on the machine. These prior exercising devices do not permit one to apply pushing and/or pulling force against the resisting force without making substantial modifications to the device, for example, by modifying pulley and cable positions. Furthermore, these prior exercising devices do not permit the return of the arm to a predetermined normal position when the application of force is released from the arm. Nor do these prior exercising devices provide for rotational motion of the outer portion of the arm, respective to the inner portion of the arm, along a horizontal longitudinal axis of the arm. In addition, these devices do not provide for the return of the outer portion to a pre-determined normal position with respect to the inner portion of the arm on release of force applied on the arm. These devices also do not provide pivotable handles which pivot about an axis perpendicular to the horizontal longitudinal axis of the arm. Nor do they provide an attachable treadmill for use with the device. Furthermore, these exercise devices do not provide for a dummy, simulating a human torso affixed to the handles to be used as a target.

Consequently, there is a need for a training and exercise apparatus which provides a rotatable arm for rotation in a horizontal plane to permit the user to apply force on the machine form a variety of positions about the circumference of the machine. There is also a need for a training and exercise apparatus which can accept both pulling and pushing motion, either separately or simultaneously, to apply force against the resisting force of the machine. There is further a need for a training and exercise apparatus which may move in the manner described above and return to the various pre-determined normal positions upon release of force on the apparatus.

SUMMARY OF THE INVENTION

The present invention provides a training and exercise apparatus which has a rotatable arm for rotation in a horizontal plane to permit application of force by the user against the resisting force of the machine in any position about the circumference of the machine. In an alternative embodiment, the present invention provides a training and exercise apparatus having a force receiving means which causes force to be applied against the resisting force upon application of either pulling or pushing force on the force receiving means, or upon application of simultaneous pulling and pushing force on the force receiving means, by the user.

According to one embodiment of the invention, there is provided a training and exercise apparatus for applying force against a resisting force. The apparatus comprises an upstanding frame and a rotatable arm supported by the frame for rotation about the frame about an arm rotation axis of rotation. A force receiving means is longitudinally slideable along the arm to cause force to be applied against the resisting force when the force receiving means is slid along the arm and receives force applied by a user A resisting force is provided. A connecting means, for connecting the force receiving means to the resisting force, is responsive to the application of the force on the force receiving means to cause force to be applied against the resisting force.

In a preferred embodiment, the rotatable arm rotates about the top of the frame in a horizontal plane.

Optionally, the arm may include a first portion adjacent the first axis of rotation of the arm, a second portion in longitudinal alignment with the first portion and a connecting means for rotatably connecting the first and second portions for rotation of the second portion with respect to the first portion about arm swivel axis of rotation, in longitudinal alignment with said portions, upon application of rotational force on the second portion. In an alternative embodiment the apparatus may include a portion returning means for returning the second portion to a pre-determined first normal position when the rotational force applied on the second portion is released. The portion returning means may be responsive to the resisting force so that the resisting force causes the second portion to return to the first normal position when the rotational force applied on the arm is released. As well, the apparatus may include a securing means for securing the second portion in a fixed position with respect to the first portion in any position about the arm swivel axis. In addition, first varying means can be provided to vary the first normal position in any position about the arm swivel axis.

As a further option, the force receiving means may include a rotating means for rotating the force receiving means with respect to the arm along a force receiving means rotation axis of rotation substantially perpendicular to the arm axis upon application of rotational force on the force receiving means. The apparatus may also include force returning means for returning the force receiving means to a pre-determined normal position when the rotational force applied on the force receiving means is released. The force returning means may be responsive to the resisting force so that the resisting force causes the force receiving means to return to the normal position when the rotational force is released. As well force receiving means securing means may be included for securing the force receiving means in a fixed position with respect to the second end in any position about the force receiving means rotation axis. Force receiving means varying means may be included for varying the force receiving means normal position and any position about the force receiving means rotation axis.

As a further option the apparatus may include arm returning means for returning the arm to a pre-determined arm rotation normal position when rotational force applied on the arm is released. The arm returning means may be responsive to the resisting force so that the resisting force causes the arm to return to the arm rotation normal position when rotational force applied on the arm is released. Arm rotation varying means may be included to vary the arm rotation normal position to any position about the arm rotation axis.

Advantageously, the force receiving means is longitudinally slidable along the arm to cause force to be applied against the resisting force when the force receiving means is pushed along said arm toward the frame, by a user. Alternatively, one end of the connecting means may be pulled by the user to cause force to be applied against the resisting force.

Preferably, the force receiving means includes a first gripping means for gripping by a user to apply force on the force receiving means. Various connecting means may be utilized. For example, a cable, wire, rope, chain or gear may be used as the connecting means.

Alternatively, the force receiving means may include lower wheels adopted for rolling on the arm and the arm may include a longitudinal upper track adopted to receive the wheels for rolling on the track. The connecting means is pullable by a user to cause force to be applied against the resisting force.

The force resisting means may include various means for applying a resisting force, for example, free or stacked weights, a spring or pneumatic cylinder, motor or magnetic resistance.

Alternatively, the apparatus may include a treadmill means for providing a movable support surface for the user to move on, the treadmill means includes a movable upper surface, the speed of movement being responsive to user input. The treadmill means is positioned opposite the rotatable arm so that the user may apply force against the force receiving means and simultaneously be supported by and move with the treadmill means.

As a further option the apparatus may include a target removably attached to the force receiving means. The target may be an artificial human-shaped dummy.

Optionally, the apparatus may have height adjusting means to adjust the height of the rotatable arm with respect to the frame. The frame may include a first portion which supports the rotatable arm and a second portion which supports the first portion. Frame adjusting means adjusts the position of the first portion with respect to the second portion to adjust the distance between the arm and the second portion.

Optionally, the apparatus may include a second arm hingedly connected to the second portion and a first pulley means rotatably connected to the arm wherein the connecting means is a cable which extends through the pulley means and wherein the pulley is pullable to cause force to be applied against the resisting force.

BRIEF DESCRIPTION OF THE DRAWINGS

An embodiment of the invention will now be described in more detail with reference to the drawings, in which.

Figure 7:
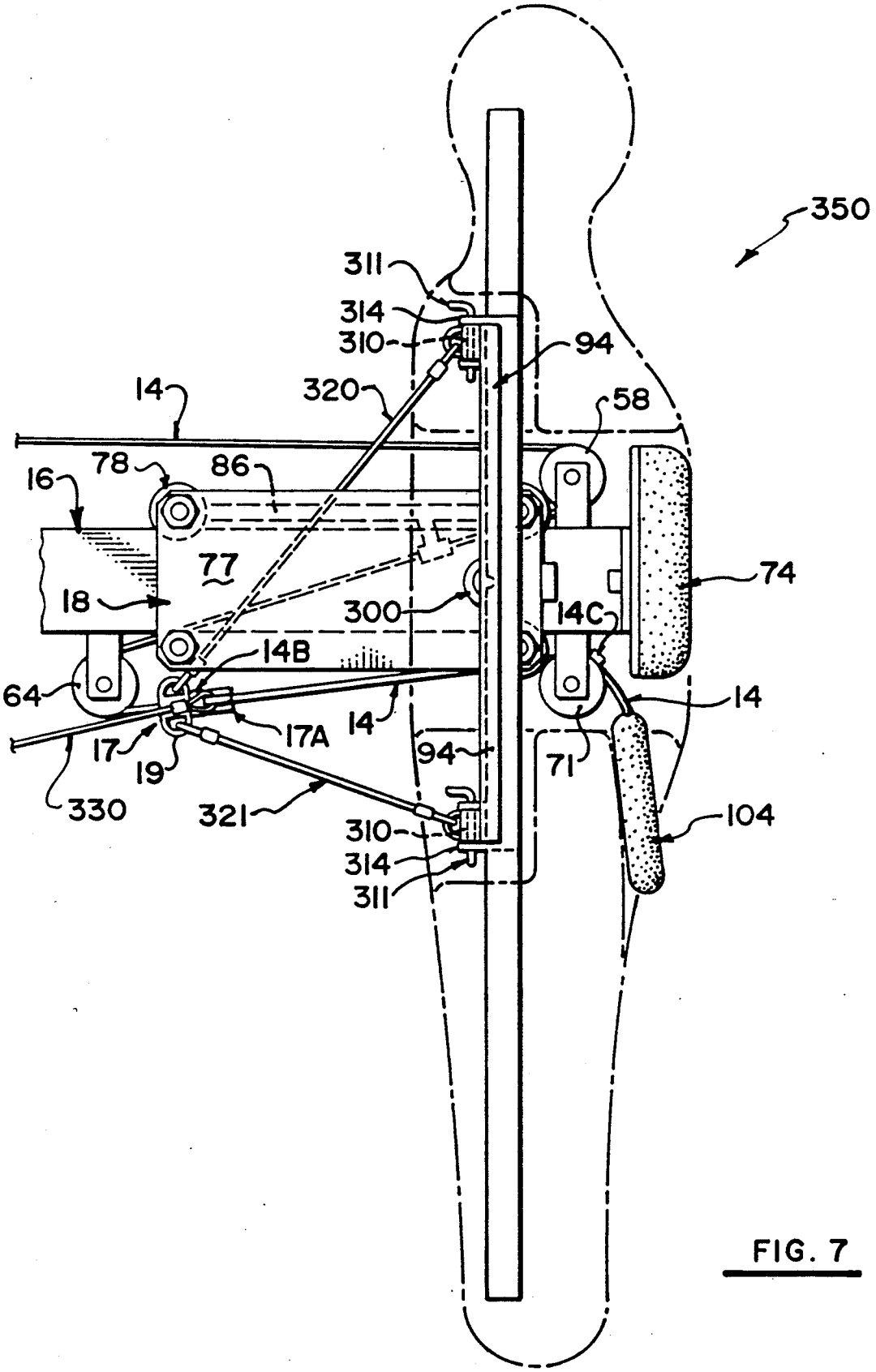
Figure 8:
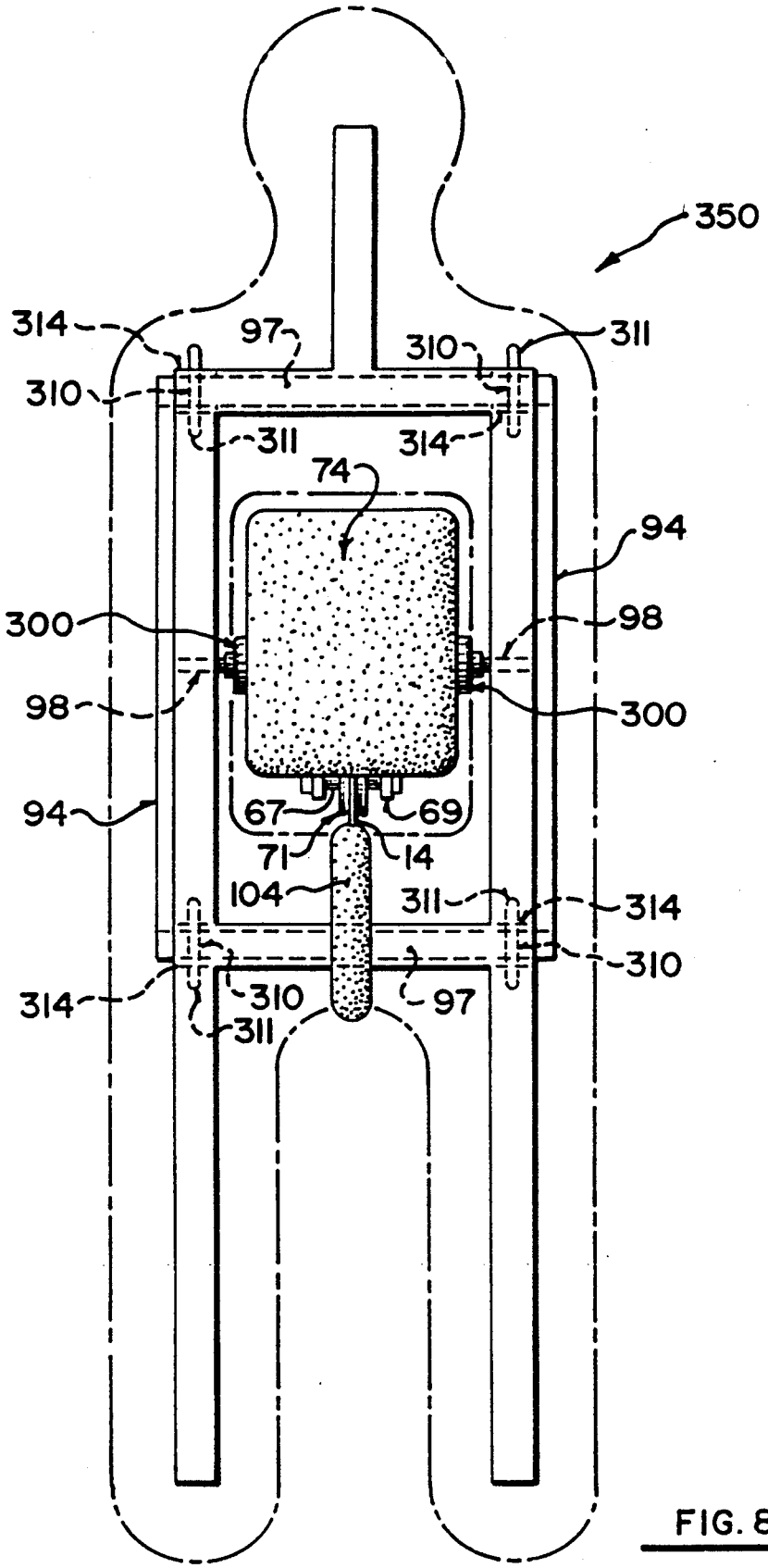
Figure 9:
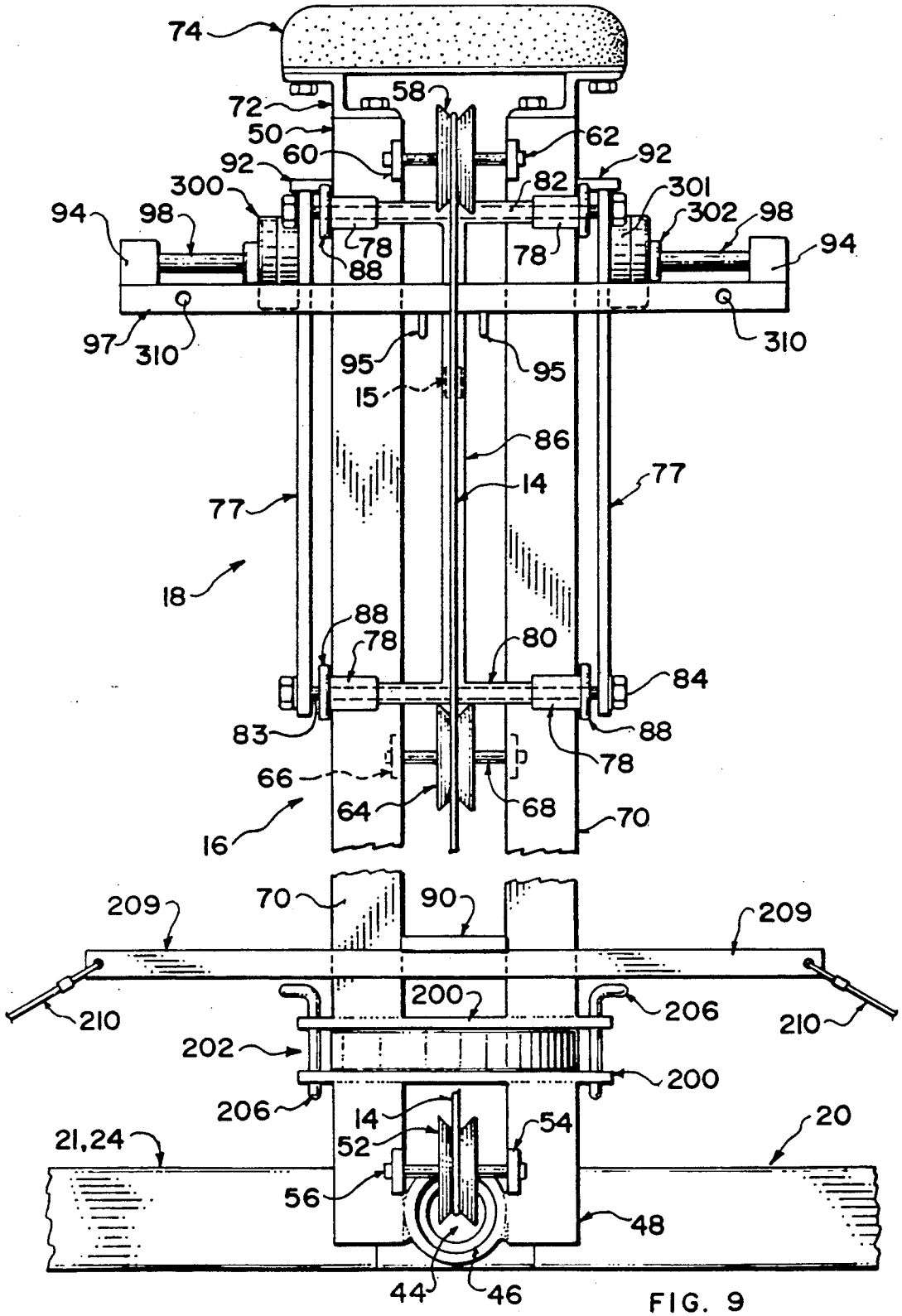
Figures 10, 13:
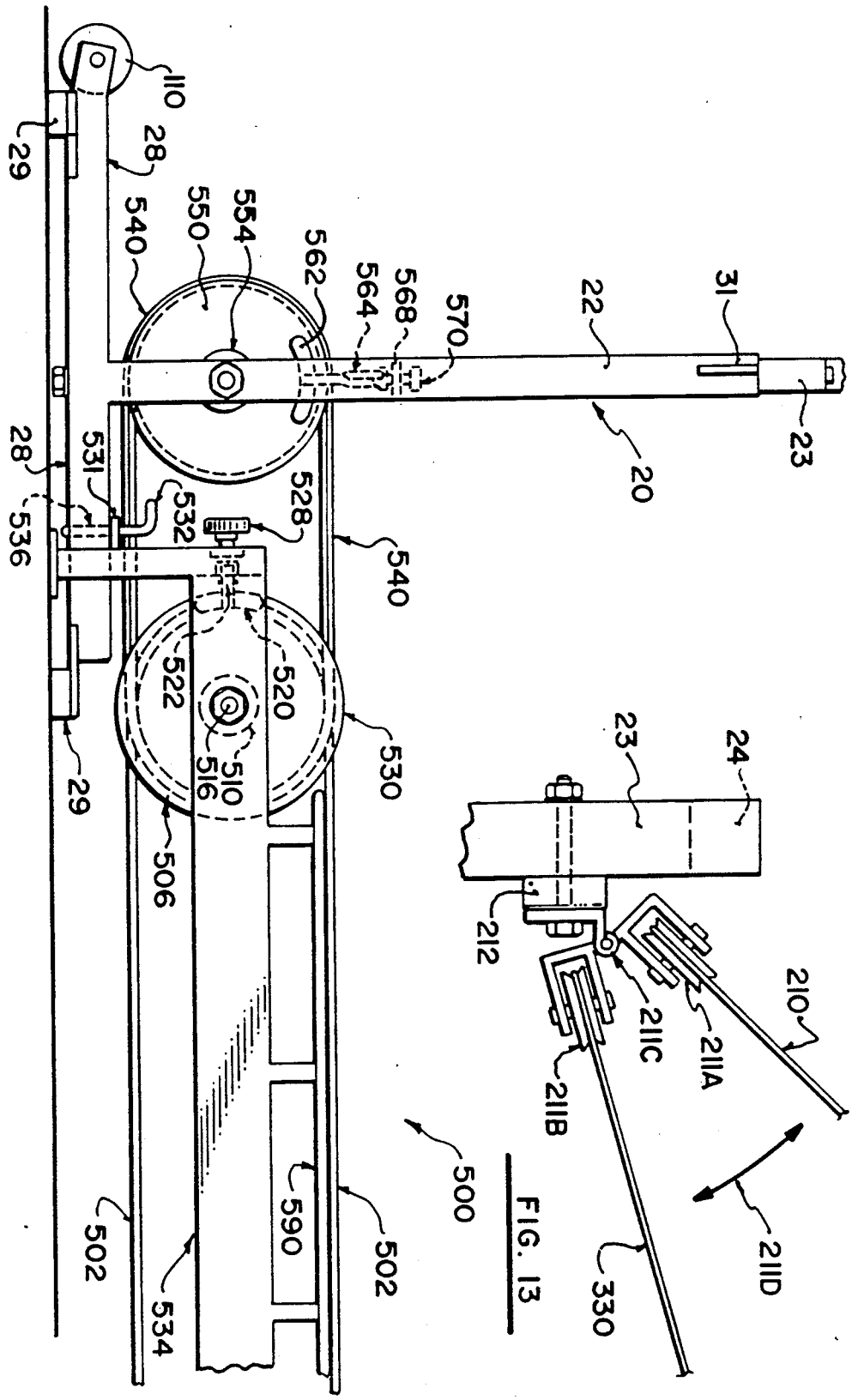
Figure 11:
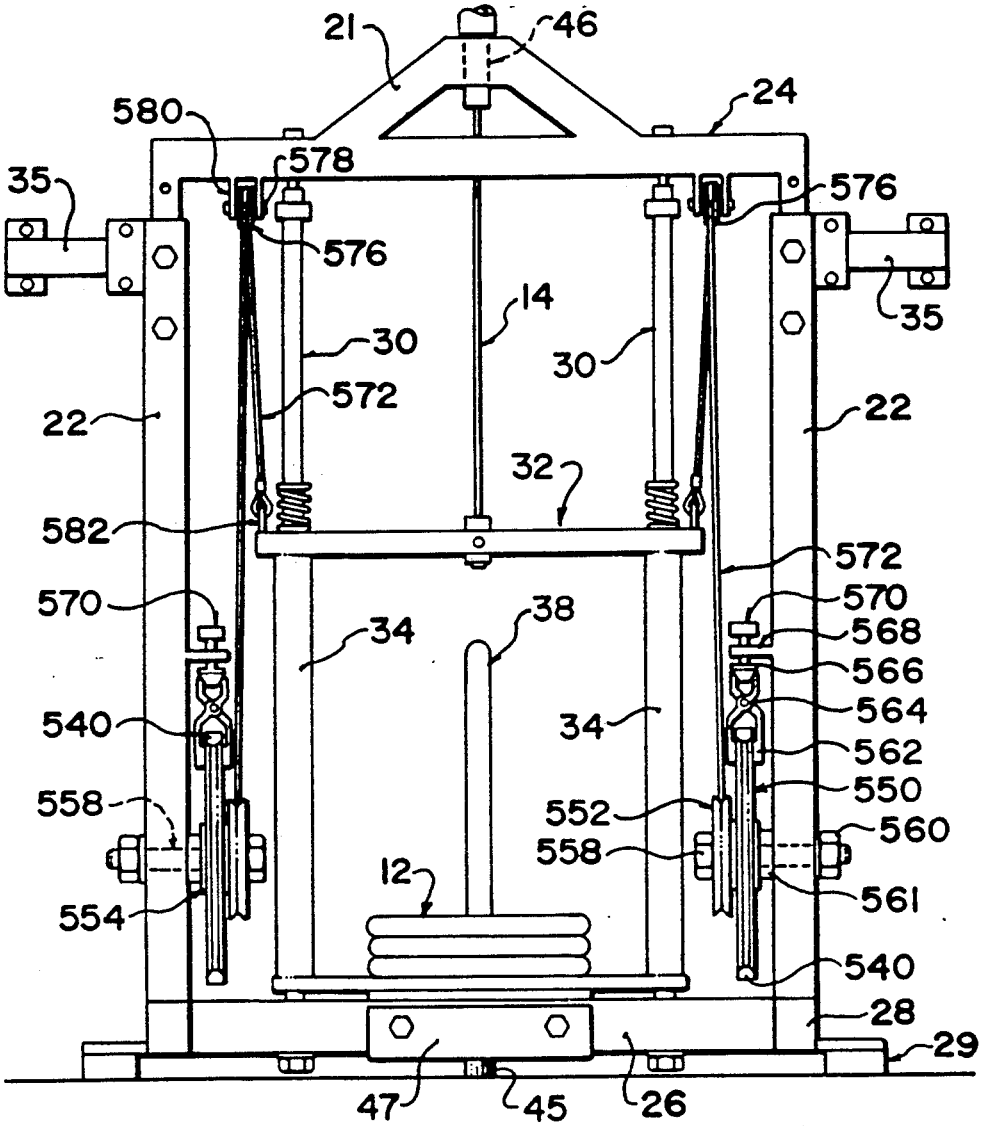
Figure 12:
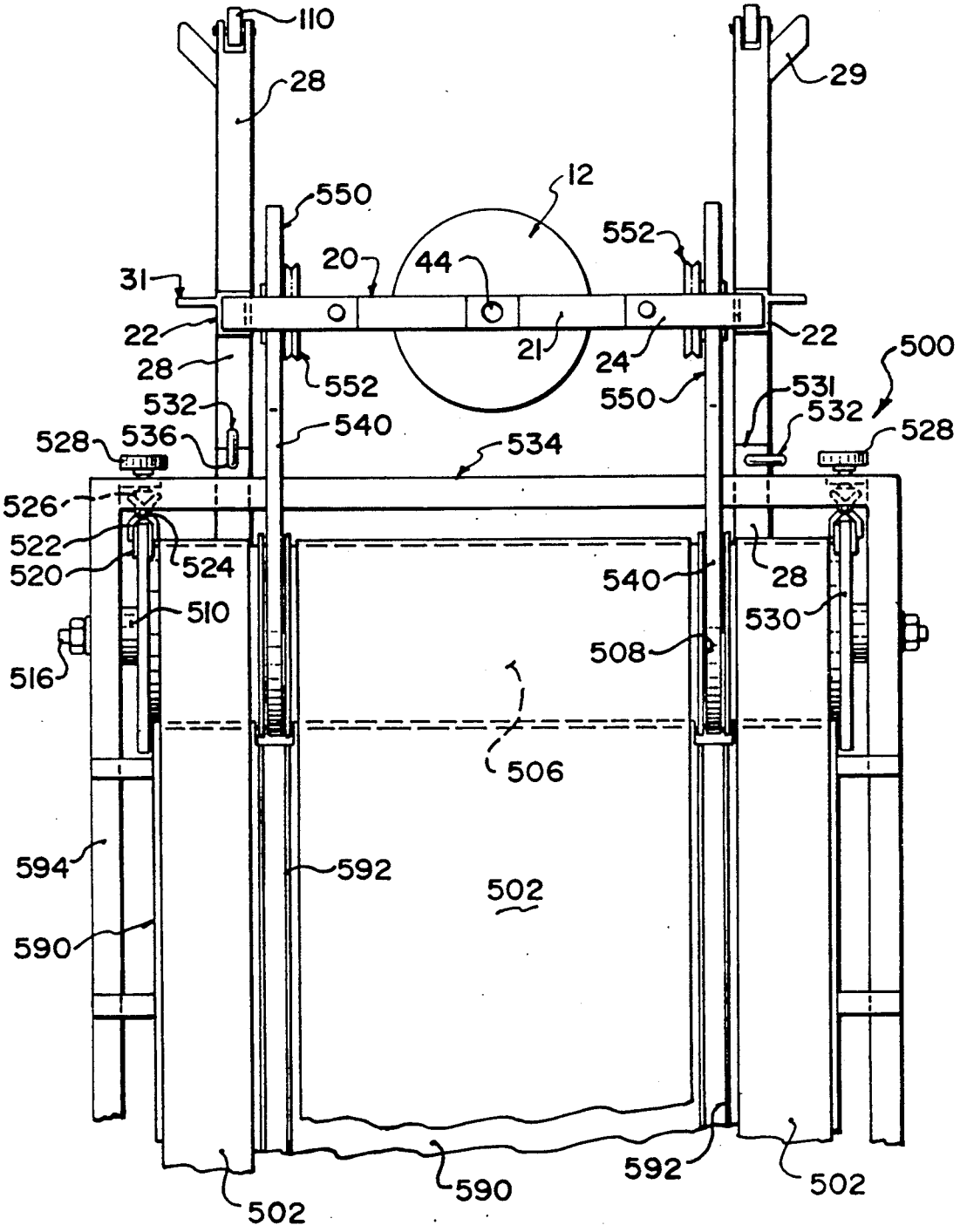

FIGS. *6a*, *6b*, and *6c* are various schemetic views of the carriage and handle frame of the present invention;

FIG. 7 is a side schemetic view of the end of the arm showing the attachment of the dummy;

FIG. 8 is a front schematic view of the view of the arm showing the attachment of the dummy;

FIG. 9 is a top view of the arm;

FIG. 10 is a partial side view of the bottom of the apparatus showing the treadmill attached thereto;

FIG. 11 is a front schemetic view of the apparatus with the treadmill braking and cable attachments shown;

FIG. 12 is a partial top schemetic view of the apparatus with treadmill attached;

FIG. 13 is a close up top view of the hinged pulley system of the apparatus.

DESCRIPTION OF THE PREFERRED EMBODIMENTS

Figure 1:
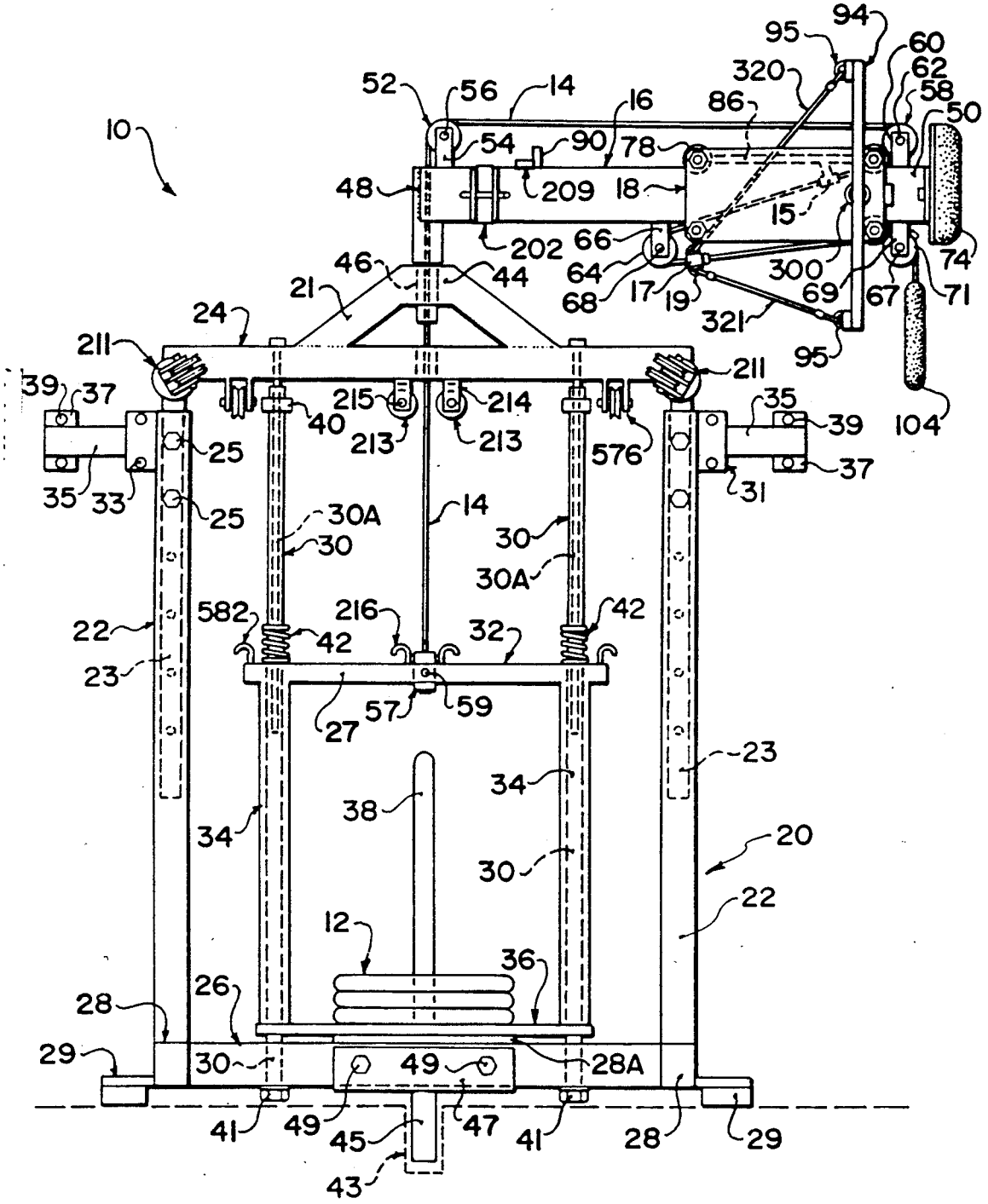
FIG. 1 is a front elevational view of a training and exercise apparatus for applying force against a resisting force, in a rest position.

Referring initially to FIG. 1, there is shown a testing, training and exercising apparatus for applying a force against a resisting force, generally designated 10, which incorporates the preferred embodiment of the present invention. Apparatus 10 basically includes a resisting force, which in this embodiment is a weight 12, a connecting means, which in this embodiment is a cable 14, a rotatable arm 16, a force receiving means, which in this embodiment is carriage 18 and frame 20. The resisting force may be varied by adding or taking away weights 12 from protrusion 38.

It should, however, be understood that a variety of force resisting means may be used. For example, a weight stack, spring or other resilient biasing means, pneumatic cylinder(s), motor driven resistance or magnetically controlled resistances may be employed. As well, various connecting means may be used, such as cable, rope, wire, chain, belt, gears and connecting rods. Furthermore, as will be appreciated by one skilled in the art, various means for receiving force may be employed such as handles of varying shapes and orientation including those roughly shaped like a human body or parts thereof, pads, clothing, ropes, hoses, and the like.

Frame 20 is rectangular in shape with two vertical side members 22. The vertical side members allow a smaller diameter members 23 to slide down into corresponding members 22. The extent of movement of members 23 into members 22 is controlled by two locking pins 25. Members 23 are joined at the top by a horizontal top member 24 and member 26 extends horizontally below side members 22. Angularly raised frame 21 is located on top of horizontal member 24 and is centered between the members 22.

The height of the arm 16 is adjustable upward and can be set higher at pre-determined increments by moving horizontal top member 24 upward allowing vertically sliding members 23 to slide upward and securing pins 25 within openings in side members 22.

Frame 20 is supported by four floor protective foot pads 29 which hold frame 20 off the floor to allow securing nuts to be attached and hold vertical guide rods 30 in position. The vertical guide rods 30 extend between top member 24 and bottom member 26. Each guide rod 30 is adjacent to and parallel with respective side member 22 and may be extended as member 24 is raised to adjust the height of arm 16. Inner rods 30A are attached to member 24 to slide within rods 30 as member 24 is raised or lowered. A rectangular weight support 32 has side members 34 for slidable vertical movement along guide rod 30. Bottom member 36 of support 32 includes centrally disposed upwardly directed protrusion 38 extending substantially the full height of support 32. Sufficient space exists for weights 12 to be added or removed from the top of protrusion 38. Weights 12 are conventional weight lifting weights, cylindrical in shape with a central opening through which protrusion 38 may extend.

Figure 2:
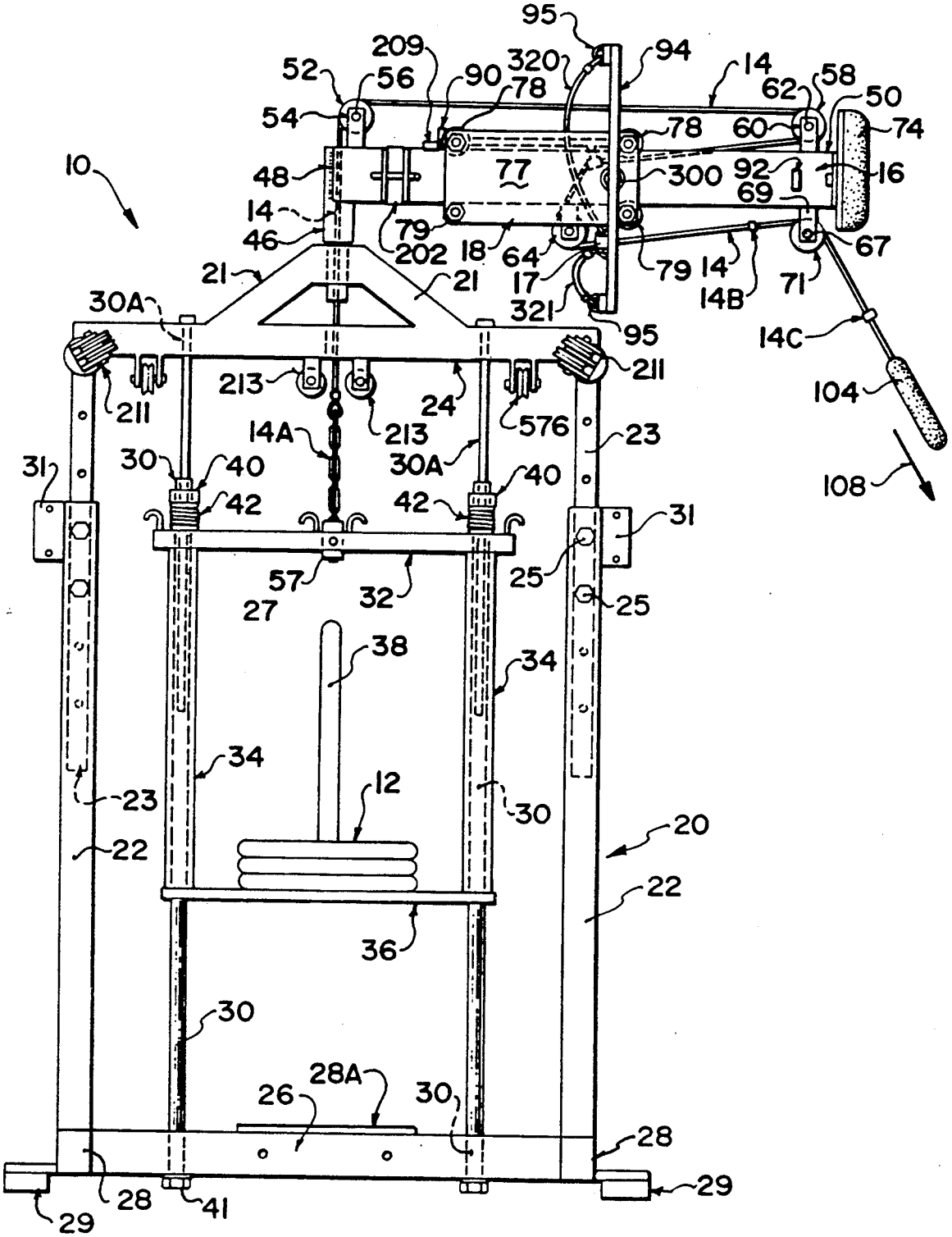
FIG. 2 is a front elevational view of the apparatus shown in a position as when force is applied against a resisting force.

Support 32 may be moved vertically between a lower position, as shown in FIG. 1 wherein bottom member 36 of support 32 rests on bottom member 26 of frame 20 and an upper position as shown in FIG. 2. Top member 27 of support 32 extends between side members 34. When support 32 is moved to the upper position slidable springs 42 positioned on guide 30 between support 32 and top member 24 and which rest on member 27 prevent support 32 from contacting top frame member 24 by stopping against stops 40, and absorb the shock of support 32 being stopped by stops 40.

Pad 28A is located on bottom frame member 26 between bottom member 36 and bottom frame member 26 to cushion the impact of member 36 when it returns to the rest position on pad 28A.

Figure 3:
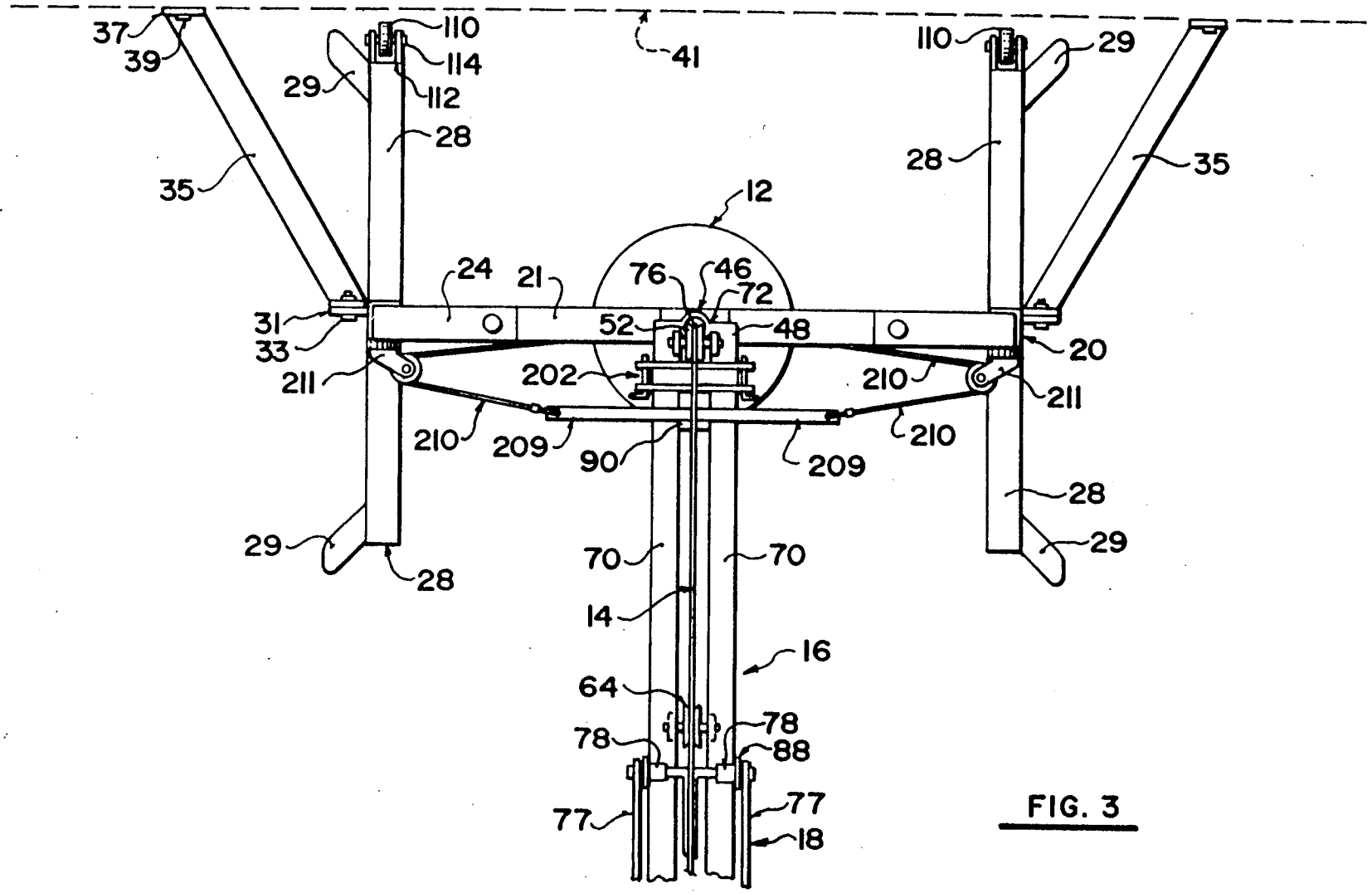
FIG. 3 is a top elevational view of the apparatus, partially broken away.

As seen in FIGS. 1 and 3, attached to the top frame member 24 is an optional wall brace including an attachment plate 31, attached by removable bolts 33, an angularly extending arm 35 which braces the frame 20 in a vertical supported position against wall 41. As best seen in FIG. 3 receiving plate 37 is attached by bolts 39 to wall 41 which supports apparatus 10. Further or alternatively, as seen in FIG. 1, the frame may be optionally attached and secured to an open floor space by a pipe 45 which is extendable into a common existing gymnasium net post receptacle 43. Pipe 45 is attached by angle iron 47 to frame bottom member 26 by removable bolts 49.

Figure 5:
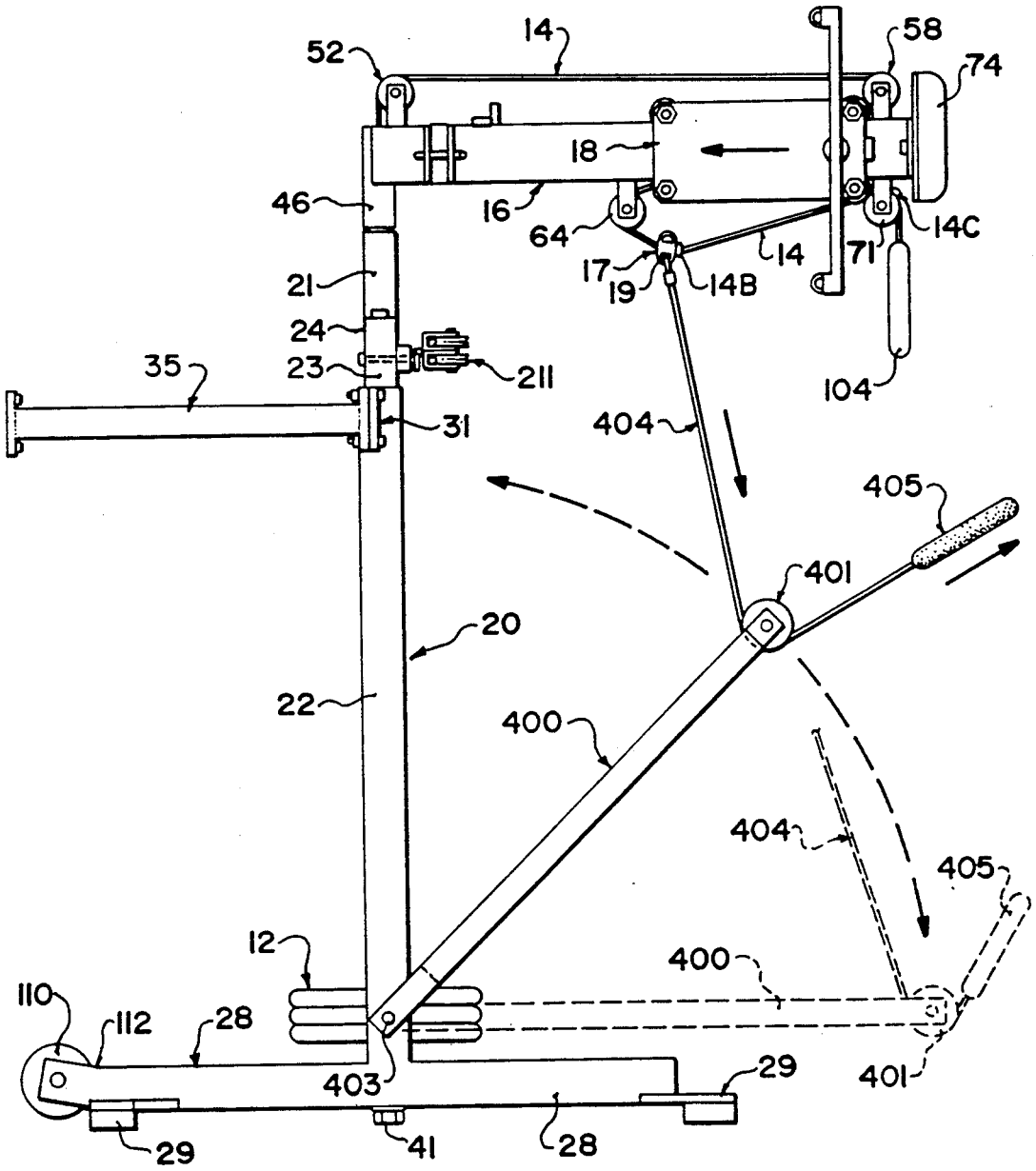
FIG. 5 is a side view of the apparatus, showing the "A" frame.

As seen in FIGS. 3 and 5, the apparatus 10 may be moved by tipping the apparatus onto wheels 110 which are attached to frame 20 by upwardly angled extending iron 112 which receives the wheel axle 114 to rotatably hold the wheel 110 (best seen in FIG. 5). Wheels 110 are rotatably attached to the ends of the iron 112 such that when the apparatus is tipped onto the wheels it facilitates the movement of the apparatus. While resting on the floor pads 29 the wheels 110 do not touch the floor.

Again referring to FIG. 1, arm 16 is rotatably attached to frame 20 by means of shaft 46 which extends perpendicularly through a bearing sleeve 44 securely housed at the mid point of the top angular frame member 21. The bearing sleeve 44 is journalled longitudinally into frame 21 and receives shaft 46 for rotatable motion of arm 16 in a horizontal plane about arm rotation axis about the top of frame 20. In order to protect a user from injury from the outer end 50 of arm 16, padded member 74 is rigidly attached to strut 72 on outer end 50.

Arm 16 has an inner end 48 and an outer end 50, inner end 48 being attached to shaft 46. Pulley 52 is rotatably mounted on the upper portion of arm 16 on inner end 48 adjacent shaft 46 by means of two parallel upstanding supports 54 which support pin 56 which extends through the axis of, and rotatably supports, pulley 52. Pulley 58 is likewise rotatably mounted to the upper portion of arm 16 on outer end 50 adjacent padded member 74 by means of two parallel upstanding supports 60 which support pin 62 which extends through the axis of, and rotatably supports, pulley 58.

Pulley 64 is rotatably mounted to the lower portion of arm 16 approximately intermediate between pulley 52 and pulley 58, but below arm 16, by means of two parallel lateral supports 66 which support pin 68. Pin 68 extends through, the axis of, and rotatably supports, pulley 64. Pulley 71 is rotatably mounted on the lower portion of the arm on the outer end 50 adjacent padded member 74, directly below pulley 58, by means of two parallel lateral supports 69 which support pin 67. Pin 67 extends through the axis of and rotatably supports, pulley 71.

Referring to FIG. 9, arm 16 is sectioned in two parts joined proximate to the inner end 48 by a bearing mechanism 202 which is shown in FIGS. 1 and 2. The arm 16 is comprised of two parallel spaced apart rails 70 joined at the outer end by a lateral strut 72 and at the inner end by shaft 46. Pulley 52, 58, 64 and 69 are positioned on arm 16 in the same vertical plane, midway between rails 70.

Carriage 18 is slidably mounted on arm 16 for movement between an outer rest position, as depicted in FIG. 1, and an inner, force application position, as depicted in FIG. 2.

Referring to FIG. 9, carriage 18 includes a pair of opposed spaced rectangular sides 77 joining four upper rollers 78 which roll on the upper surface of rails 70 and four lower rollers 79 (shown in FIG. 2) which roll on the lower surface of rails 70 to support carriage 18 on arm 16. Rollers 78 are rotatably attached to carriage 18 by means of upper axles 80 which rotatably supports an opposed pair of rollers 78. Axle 80 is secured to side members 77 by means of through bolts 83 extending through an inner cavity in each roller 78. Axles 80 are connected by a hollow beam frame 86, perpendicular to axle 80. Rollers 78 have outer circular lateral flanges 88 which act to keep the rollers on rails 70. Flanges 88 on opposed rollers 78 are positioned to rotate adjacent opposite outer edges of respective rails 70.

As seen in FIG. 2, similarly, four bottom rollers 79 are positioned on carriage 18 below arm 16 for rolling on the lower surface of rails 70. Through bolts (not shown) extend from one side 77 to the other side 77 to rotatably attach outer rollers 78 to sides 77 in a manner similar to that described above with respect to rollers 78. Inner bottom rollers 79 are attached to sides 77 by short bolts (not shown) rather than through bolts to permit carriage to slide past pulley 64, as shown in FIG. 2. As well, inner bottom rollers do not include flanges.

As can be seen in FIG. 2, rollers 78 and 79 are positioned to sandwich arm 16 between rollers 78 and 79 to slidably retain carriage 18 onto arm 16 and to provide a minimum of vertical "play" of carriage 18 on arm 16. Lower rollers 79 are positioned adjacent each lower corner of sides 77. Upper rollers 78 connected through the hollow beam frame 86 are positioned adjacent the inner upper corner of sides 77.

As seen in FIGS. 2 and 9, in order to prevent carriage 18 from contacting pulley 52 when carriage 18 is pulled or pushed to its inner position, stop 90 is secured between rails 70 at a suitable position proximate to the connecting bearing mechanism 202 to contact inner axle 80 and prevent further inner travel of carriage 18. In order to prevent carriage 18 from contacting pulley 58 when carriage 18 is returned to its outer, rest position, a stop 92 is positioned on each outer side of rails 70 near padded member 74 at a suitable position to contact side members 77 and prevent further outer motion of carriage 18. In this manner carriage 18 is constrained to move between stop 90 and stops 92 along arm 16.

Referring now to FIG. 9 to illustrate the construction and function of bearing mechanism 202 attaching the inner end 48 and outer end 50 of arm 16 proximate to shaft 46. Strut end plates 200 extend laterally beyond the side rails 70 of arm 16 to allow the arm to be secured in a vertically aligned position by a pin 206 inserted through holes (not shown) on each side of the arm 16. When the pins 206 are removed the outer end 50 of arm 16 is rotatable to the left or to the right by bearing mechanism 202. In this manner the bearing allows the outer end 50 of arm 16 to rotate on its longitudinal axis or arm swivel axis in relation to inner end 48 of arm 16, in the direction of arrows 230 in FIG. 4. The rotation of outer end 50 may be selectively controlled by arm swivel varying means to affix outer end 50 in selectable rotation positions with respect to inner end 48 through the use of pins 206 inserted through holes located about the periphery of strut plates 200.

As an alternative embodiment a universal joint (not shown) may replace the bearing mechanism 202 to permit rotation of outer end 50 in a horizontal plane in the direction of arrows 230 and also to permit simultaneous movement of end 50 upwardly or downwardly from the horizontal.

Figure 4:
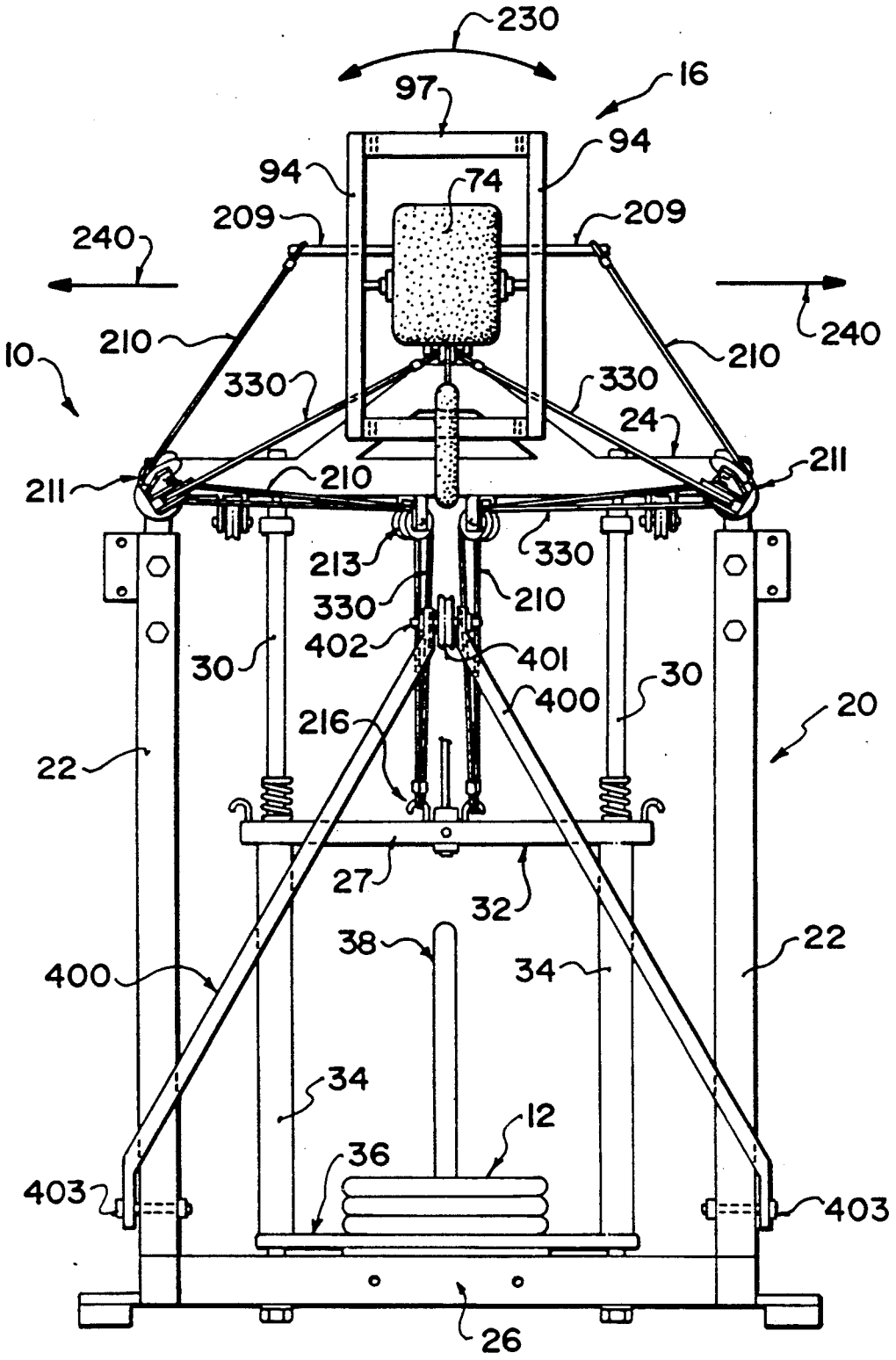
FIG. 4 is a front elevational view of the apparatus showing the positioning of the pulley systems and cable used to return the arm to the predetermined normal positions.

Referring to FIGS. 3 and 4, the rotation of outer end 50 of arm 16 with respect to inner end 48 of arm 16 in a longitudinal axis in the direction of arrows 230 can optionally be controlled by weights 12 to cause outer end 50 to be returned to an arm swivel normal position. Lateral bars 209 are transversely attached to arm 16 adjacent the outer end of bearing 202. Cable 210 is attached at each end of lateral bar 209. Cable 210 is connected to weight support 32 through pulleys 211 on horizontal top frame member 24. Cable 210 then travels through pulleys 213 attached to the underside of horizontal top frame member 24 downwardly where it is attached by hook 216 to weight support 32. The orientation of cable 210 is best seen in FIG. 4. Pulley 211 is rotatably attached to member 24. Pulley 211 is a double pulley system, each pulley being pivotable, independent of the other pulley. In this way, the specific angle of pulley 211 is determined based on the force applied by cables 210. Pulleys 213 are also double pulley systems and are rotatably attached to the underside of member 24. Thus with this connection of cable 210 to the resistance weight 12 the weight is lifted with rotation of outer end 50 along a longitudinal axis. Furthermore, upon release of rotational force on outer end 50, arm 16 returns to a normal position with weights 12 returned to a lower position (FIG. 2) by force of gravity.

Referring to FIG. 4, arm 16 may be attached by cables to support 32 to return arm 16 to a arm rotation normal position on release of rotational forces (in the direction of arrows 240) on arm 16. As seen in FIGS. 4 and 7, a pair of cables 330 extend from sleeve 17A which is slidably secured about cable 14 adjacent and outward of stop 14B. As seen in FIG. 4, cables 330 extend through pulleys 211 on horizontal top frame member 24. Cables 330 extend through pulleys 213 on the bottom of top frame member 24 and downwardly where cables 330 are attached by hooks 216 to weight support 32. Thus when arm 16 is rotated in the direction of arrows 240, cables 330 cause support 32 to be lifted. Upon release of rotational force the weights 12 cause support 32 to move downwardly and cables 330 pull arm 16 to the preselected normal position. The normal position may be varied by arm rotation varying means by varying the length of cables 330. FIG. 4 is exemplary and depicts the arm rotation normal position as a position perpendicular to the plane of frame 20.

Referring to FIG. 13, hinge 211 is rotatably attached to member 23 by means of bearing 212. Hinge 211 consists of pulley 211A and pulley 211B hingedly connected by means of hinge 211C. Hinge 211C permits pulley 211A and 211B to be hinged in the direction shown by arrows identified at 211D. Pulley 211A supports and guides cable 210 and pulley 211B supports and guides cable 330.

The connecting means, here cable 14, will now be discussed with reference to FIGS. 1 and 2 and with FIGS. 6A, 6B and 6C. One end of cable 14 is connected to support 32 by means of a swivel attachment 57 which is secured to the cable 14 by means of a set screw 59. Depending on the height of arm 16, as adjusted by the user by raising or lowering top frame member 24, chain links 14A are added or removed from the end of cable 14 to maintain support 32 adjacent bottom member 26 when support 32 is in the lower rest position. Cable 14 extends upwardly through vertical opening (not shown) in shaft 44. Cable 14 extends through arm 16 to pulley 52 which has an annular groove about its circumference (not shown) to accept and retain cable 14 about pulley 52. Cable 14 then extends substantially horizontally to pulley 58 which also has an outer groove about its circumference to accept and retain cable 14 about pulley 58.

Cable 14 loops around pulley 58 in an inward direction and extends to pulley 64. Pulley 64 also has an outer groove about its circumference to accept and retain cable 14 about pulley 64. Cable 14 then extends outward to pulley 71 which also is grooved to accept and retain cable 14 therein. Grip rope 104 (or other gripping objects) is attached to the end of cable 14 adjacent pulley 71. Preferably, the length of cable 14 selected will be just enough to provide for the attachment of grip rope 104 to cable 14 just beyond the periphery of pulley 69 when support 32 is in its lowered or rest position as shown in FIG. 1. Stop 14C is positioned adjacent rope 104 to prevent the end of rope 104 from contacting pulley 71. Stop 14C (FIG. 2) contacts supports 69 to prevent outer end of cable 14 and rope 104 from moving inwardly past support 69.

Figure 6A:
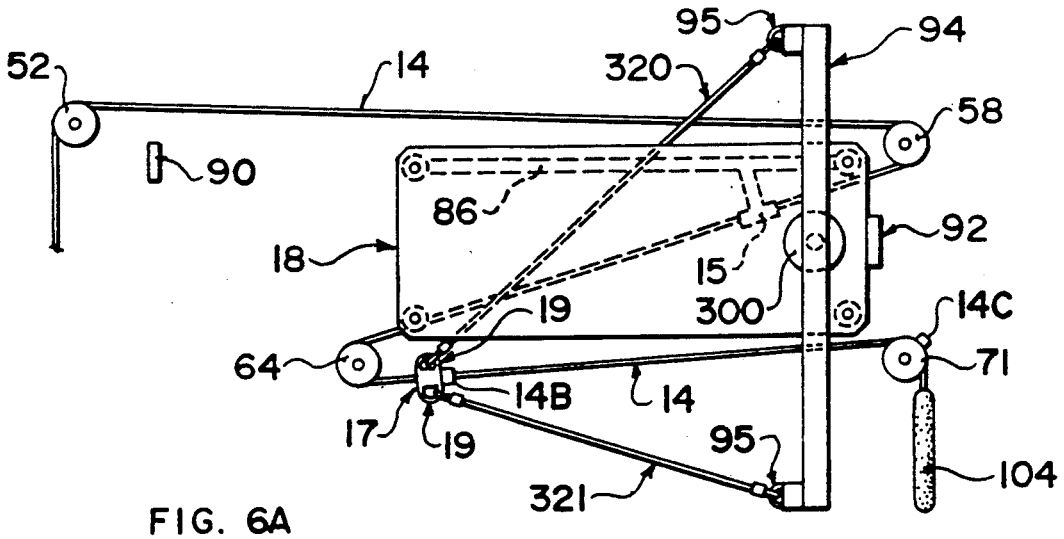
Figure 6B:
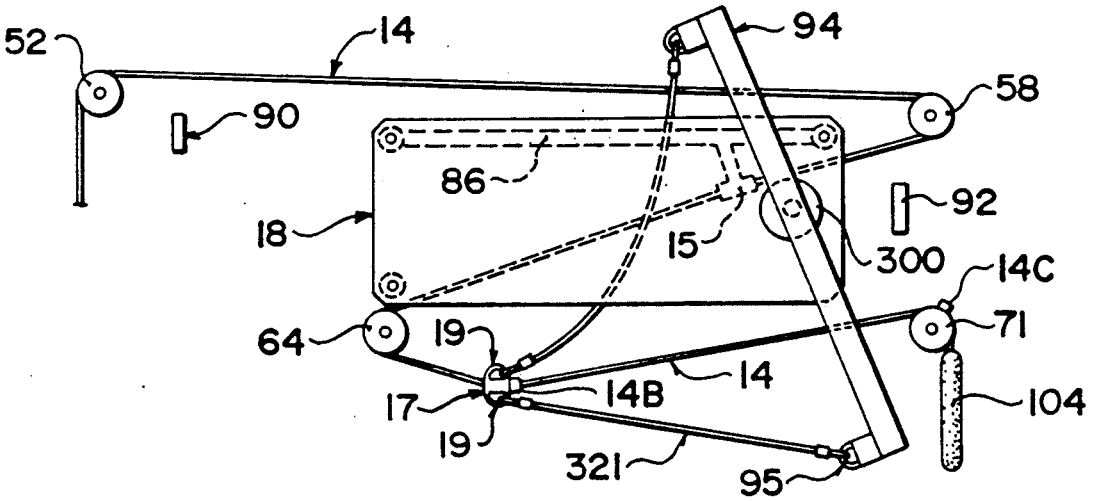
Figure 6C:
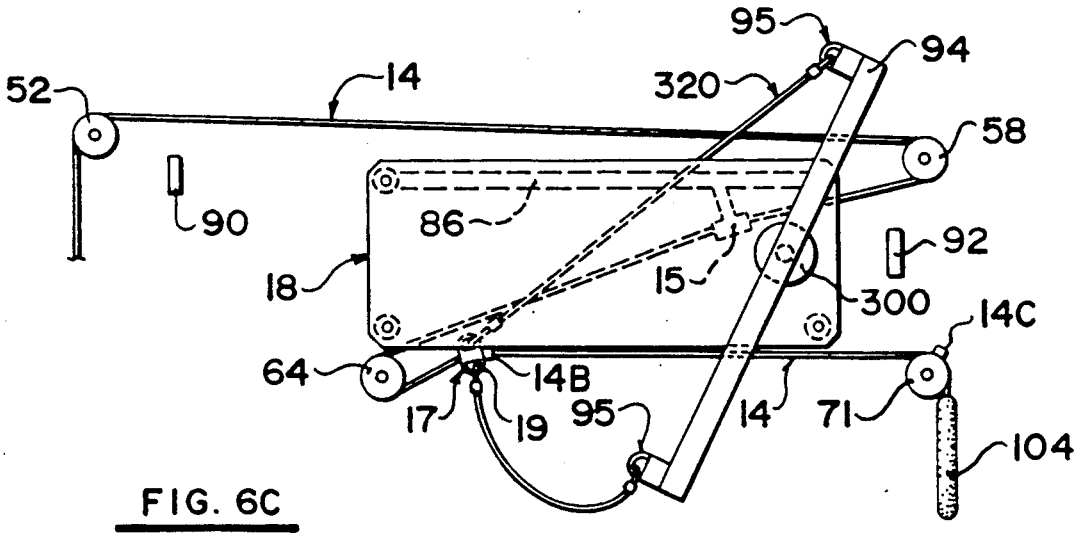

As seen in FIG. 6A, 6B and 6C, cable 14 is rigidly attached to carriage 18 by means of anchor sleeve 15 which is attached to the underside of the frame 86 by means of a protruding arm. Set screws (not shown) through sleeve 15 are used to rigidly attach cable 14 to sleeve 15. Movement of carriage 18 towards pulley 52 will thereby cause cable 14 adjacent sleeve 15 to be moved inwardly with carriage 18, thereby lifting support 32. As well, pulling action on grip rope 104 (as for example in the direction of the arrow shown at reference numeral 108 of FIG. 2) will cause carriage 18 to move toward pulley 52 and will, again, cause cable 14 to lift support 32. In this manner, pushing action on handle frame 94 or pulling action on grip rope 104 will cause lifting force to be applied to support 32. Furthermore simultaneous force on handle frame 94 and pulling force on rope 104 may be applied to move cable 14 to lift support 32.

The pivoting action of handle frame 94 and the centering resistance action of arm 16 on frame 20 will now be discussed with regard to FIGS. 6A, 6B and 6C. Handle 94 is secured in a vertical position by a pin lock system (not shown) adjacent to rotational bearing system 300 located mid point in the vertical member of handle frame 94. The top and bottom members 97 of the handle 94 connect the two parallel vertical handles and have at their mid point a connecting ring 95 to which ends of upper cable 320 and lower cable 321 may be attached. The opposite ends of cables 320 and 321 are attached to a cable locking sleeve 17 by means of attachment rings 19 located on the upper and lower side of the sleeve 17. Sleeve 17 is slidably fastened about cable 14. At a location just outside pulley 64 when carriage 18 is in the rest position (as depicted in FIG. 6A). Stop 14B is securely fastened to cable 14 by means of a set screw (not shown).

FIG. 6A illustrates the handle frame 94 in the vertical rest position. FIG. 6B illustrates the effect of pushing the top portion of the frame 94 in an inward direction or of pushing the bottom portion of frame 94 outwardly. Both actions move sleeve 17 outwardly to contact stop 14B which causes cable 14 to move the weight support 32 upward from its rest position. FIG. 6C illustrates the effect of pulling the top portion of the handle frame 94 outwardly or of pushing the bottom portion of frame 94 inwardly. When sufficient force is applied in this manner cable 14 is also moved to cause support 32 to be moved upwardly.

FIG. 9 is a cutaway plan view of the outer end 50 of arm 16 illustrating the carriage 18 system and the attached handle frame 94. The handle frame is attached to sides 77 through bearing 300 which has its outer ring attached to the carriage sides 77 thus rotatably securing the base of the handle system to the carriage 18 about force receiving means rotation axis. The inner ring of the bearing 300 is attached to an extension member 98 to position the vertical handle members equidistant from arm 16. The distance between handles frame 94 is approximately 14 inches which is the approximate width of the average adult human male torso. The length of the handles 94 is such as to provide resistance when connected via cables 320 and 321 to cable 14 and thereby to the weights 12.

FIGS. 7 and 8 illustrate the optional attachment of a lifesize padded force receiving dummy 350. FIG. 7 is a side elevation cutaway of the outer end 50 of arm 16 showing the frame handle system 94 to which the force receiving dummy 350 can be attached. FIG. 8 is a front elevation of the force receiving dummy 350. The force receiving dummy 350 is specifically designed to be removably attached to the handle frame 94 by placing the frame of the force receiving dummy 350 on the upper and lower members 97 of the handle frame 94. Extending metal brackets 314 fit over horizontally located upper and lower members 97 of the handle frame 94 and are secured in place by pins 311 which are secured into holes (not shown) in brackets 314. The force receiving dummy 350 is constructed of dense foam to match the resiliency of a muscled human body as close as possible. The foam is poured over and thus bonded to the frame in such a manner as to leave an access port to attach the force receiving dummy to the handle frame 94 and to allow the passage of outer end 50 of arm 16 through dummy 350.

FIGS. 4 and 5 illustrate the option of attaching an "A" frame 400 to side members 22 of apparatus 10. The frame 400 is attached by a removable bolt system 403 which allows the frame to freely pivot to a position determined according to the force angle being applied by the user. The "A" frame (FIG. 5) includes a pulley 401 rotatably attached to the outer end of the frame 400. Cable 404 is connected at one end to sleeve 17 by attachment to ring 19, and at the other end to pulling rope 405 through pulley 401. Rope 405 may be removed and replaced by various objects. As an example simulated fire hose may be attached to the end of cable 404. Applying lifting and pulling forces to cable 404 moves the "A" frame 400 to the force angle and the applied force is transferred to cable 14 via the sleeve 17, thereby moving carriage 18 inwardly along the arm 16 and lifting the weight 12.

FIGS. 10, 11 and 12 illustrate apparatus 10 with the optional attachment of a treadmill 500 through tension belts 540. The treadmill 500 is attached to frame 20 of apparatus 10 by means of a bracket extension 531 attached to the frame 534 of the treadmill 500 with aligned holes 536 matched to receive pins 532.

Referring to FIG. 12 the treadmill cylinder 506 is designed with grooves 592 and guides 508 into which tension belt 540 rotatably fits. Guides 592 also position the treadmill running beds 502 on the treadmill 500 support beds 590 over which the running surface 502 slide. Depending on the width of the treadmill bed desired, the bed may be split into three separate running beds (contact surfaces) the middle of these three surfaces in this current design is defined by the width of the apparatus frame 20. The width of cylinder 506 can thus be any preferred width. Guides 508 and cylinder end plate 530 maintain treadmill running beds 502 in position. The connecting tension belts 540 are positioned apart from one another a suitable distance so as to minimize treadmill beds 502 foot contact with the support beds 590.

Guides 508 of cylinder 506 also align the tension belt 540 with the tension wheels 550 on the frame 22 of the apparatus. The cylinder 506 is secured within the frame of the treadmill by a typical bearing mount system through which a transverse cylinder axle 516 is supportedly attached to the treadmill frame 534.

As seen in FIG. 11, the treadmill braking system is comprised of brake pads 520 fitting over the cylinder endplate rim 530 of cylinder 506. The braking forceps 522 tighten against the brake pads 520. Pressure is applied by screwing the handle 528 which causes the forceps 522 to tighten on the braking pads 520. This same system is used on tension wheels 550. Screw 570 is tightened against pressure plate 566 which causes pressure to be exerted by the forceps 564 onto the brake pads 562 located on opposite sides of the wheel 550. The braking system is mounted on a bracket 568 attached to frame member 22 of apparatus 10. The wheel 550 is rotatably secured by an axle bolt 558 and nut 560 which passes through frame member 22. Spacers 561 are attached to the frame member 22 to which the outer ring of the bearing 562 is attached. The wheel 550 is fitted to the axle 558 and is aligned channels 508 around which the tension belt 540 is mounted. In this way movement of treadmill running beds 502 causes movement of belt 540 to rotate wheel 550.

Pulley 552 is attached to the wheel 550 which, in turn, is attached to one end of cable 572. Cable 572 passes upward and through pulley 576 which is rotatably attached to member 24 between side members 22 and guide bars 30. The end of cable 572 is attached to cable receiving hook 582 at the outer top edges of support 32. Thus when force is applied either in a forward or rearward direction on the treadmill the wheel 550 will windingly pull cable 572 about pulley 552 and pulley 576 and cause support 32 to be lifted until slippage of belt 540 occurs.

OPERATION

The apparatus 10 allows a user to be tested, to train or to exercise against a simulated opponent. The user is able to measure current physical capabilities and progressively train toward projected physical abilities. The user can set the level of resistance to reflect various testing, training or exercise regimes. The user may select various options, as discussed below, depending on the muscle groups for which testing, training or exercise are desired. The user positions him/herself adjacent apparatus 10 in order to effectively apply pulling, pushing, rotational and pivoting forces, in any combination, on the various components of apparatus 10.

Apparatus 10 is also useful in measuring and determining minimal acceptable physical abilities of an individual. As examples, one may test a person's ability to pull a fire hose, of a pre-determined resistance, over a pre-determined distance or time, or the ability of a football lineman to apply force against the force receiving dummy a pre-determined number of times within a given time period at a given resistance force amount.

Apparatus 10 is also useful to those who treat and rehabilitate physical injuries as apparatus 10 enables the user to apply progressive levels of force using specifically selected injured muscle groups of the user.

The basic operation of apparatus 10 will now be described with reference to the figures. The user of the apparatus must decide the testing, training or exercise protocol or regimen that is to be performed. The user may employ designed stop or limiting mechanisms to fix the rotational movements of the arm 16 or choose to attach or detach connective cables as needed to conduct a particular test, training or exercise regime. Further, the user must decide the appropriate force receiving device to be used, these include objects such as a dummy 350 attached to handles 94, or grasping objects such as a fire hose nozzle or rope 104. The user must select the level of resistance to be applied against the user by selecting the number and weight of weights 12 on protrusion 38. The apparatus may be positioned in an open unrestrictive area for use throughout of rotation of arm 16. Apparatus 10 may be securely supported by using the floor attachment 43 into a hole in the floor or by using a wall support 450, illustrated in FIGS. 3 and 5.

The basic operation of the apparatus 10 will be discussed with reference to FIGS. 1 and 2. The user orients the arm 16 to a desired position within a horizontal 360 degree plane about shaft 46. The length of arm 16 is approximately the average adult male arm length. The application of force by a human can be either linear, rotational or partially linear and partially rotational in direction.

The height of the arm 16 from the floor is adjustable to vary the simulated opponent's body position or center of gravity. This is accomplished by raising or lowering the member 24 of frame 20 seen in FIG. 1 and by adding or taking away chain links 14A as shown in FIG. 2. Sufficient links are added to cable 14 to correspond to the distance member 24 is lifted. Similarly other cables attached are lengthened to correspond to an increase in the height of arm 16.

Referring to FIG. 1, when a user pushes on to the handle grips force is applied to carriage 18 to move carriage 18 inwardly on arm 16 toward the center of shaft 44. Anchor sleeve 15 moves cable 14 as carriage 18 is moved. Cable 14 thereby lifts support 32. As the carriage is pushed toward shaft 46, weight support 32 is raised upwardly against gravity proportionate to the distance the carriage is moved on arm 16. FIG. 2 illustrates weight support 32 in the upper position.

Alternatively, referring to FIG. 1, when a user pulls on grip rope 104 the cable 14 is pulled and weight support 32 and weights 12 are thereby lifted proportionate to the travel distance of carriage 18 on arm 16 as is illustrated in FIG. 2.

Referring to FIGS. 3 and 4, the user may apply force to cause pivotal movement of outer end 50 with respect to inner end 48 about the arm swivel axis in the direction of arrows 230. The user selectively attaches cables 210 between attachment 216 of support 32, over pulley 213 to pulley 211 and then onto outer end 50 via lateral bars 209. This is done on each side of arm 16. The user is able to apply rotational forces about the arm swivel axis of arm 16 to cause support 32 and weights 12 to be lifted. Thus the user may raise weights 12 as the carriage 18 moves toward shaft 46 and as arm 16 is rotated in either direction about the horizontal longitudinal axis of arm 16. Any singular or combination of said applied forces may move the weights 12 upwards against gravity.

The attachment of cable 330 causes the "self centering" of the arm 16 to an arm rotation normal position as shown in FIGS. 4 and 7. Pulley system 211 which guides cable 330 to pulley 213 (see FIG. 1) and downward to hooks 216 to support 32 and outwardly to connecting and attachment sleeve 17 to cable 14. The user applies lateral force in the direction of arrows 240 to the handle grips 94 to lift weights 12. Arm 16 will return to its normal position on releasing the force. This option will allow immediate repeated applications of lateral force against the handle grips 94.

Referring to FIGS. 6A, 6B, 6C and 9, the user is able to apply pivoting force about force receiving means rotation axis on handle grips 94 by selectively attaching cables 320 and 321 to respective rings 19 and to respective attachment rings 95 located on the upper and lower vertical members of grips 94. Cables 320 and 321 are marginally off-set of center to allow free passage of each cable past cable 14. The user is able to apply pivoting forces about force receiving means rotation axis to the handle grips 94 as shown in FIGS. 6A, 6B and 6C. As the upper handle 94 is pivoted outward by the lower part of handle 94 is pivoted inwardly which pulls on cable 321 which pulls sleeve 17 against stop 14B located just outwardly of pulley 64 when carriage 18 is in the rest position. By pulling on cable 321 cable 14 is thereby also pulled outwardly, thereby lifting support 32. Similarly, upon pulling the upper part of handle grips 94 outwardly, cable 320, attached to sleeve 17 by ring 19, will pull cable 14 outwardly and thus move the carriage 18 inwardly and weight 12 will be lifted.

The user may thereby cause the weight 12 to be lifted through applied forces of pulling, pushing, rotating the arm 16 in a horizontal plane and/or by pushing and/or by pulling on the upper extremities of handle 94 as well as rotating arm 16 on its longitudinal axis. All of these forces will act collectively on weight 12.

Referring to FIGS. 7 and 8, a force receiving dummy 350 is designed to selectively attached to handle grip 94. The foam dummy is poured over a metal frame which has extensions 314 which slide onto the upper and lower members of handle system 94 and are secured there by pins 311. This positive attachment of the dummy will allow the user to apply any combinations of directional forces to the dummy and have the efforts reflected through the movement of weight 12.

Referring to FIGS. 4 and 5, a user may selectively attach the "A" frame 400 to apparatus 10 at the base of upright members 22. Pulley 401 is located at the outer end of frame 400 and guides connecting cable 404 to cable 14 via sleeve 17 via ring 19. A user lifting and pulling on rope 405 thus effectively pulls cable 14 which is attached to carriage 18 by anchor sleeve 15.

Should the user decide to use the apparatus in conjunction with the designed treadmill 500 (FIGS. 11 and 12) the treadmill must be attached to the apparatus by a pin 536 and by tension belt 540. This connection allows the aligned set resistance on the tension belt of the treadmill to effectively lift weight 12 and to keep it raised through the slippage of belt 540 on to cylinder 506 and tension wheels 550 attached to frame 20 of apparatus 10. The application of force can be of any duration over any desired distance due to the slippage of tension belts 540. The amount of resistance desired is determined by the user in applying weight 12 and coordinating the braking resistance with the treadmill systems.

The combined braking resistance provided through 528 and 568 is coordinated with resistance 12 so that the combined force provided by the legs and the arms on the apparatus raises support 32. Movement of the legs on the treadmill bed 590 may be either forward, rearward or forward and rearward alternatively and within defined body contact angles limited by the width of the treadmill running surface.

The apparatus 10 can be attached to a motorized treadmill in a similar manner. When using a motorized treadmill the resistance is designed into that system by installing a non-slip treadmill running bed on the rotating drums. Thus when a user is moving on the treadmill at a given speed and wishes to apply a pre-determined amount of directional force then the user pushes on the dummy 350 and lifts the weight 12 corresponding to the pre-determined force while running on the treadmill.

As will be apparent to those skilled in the art in the light of the foregoing disclosure, many alternations and modifications are possible in the practice of this invention without departing from the spirit or scope thereof. Accordingly, the scope of the invention is to be construed in accordance with the substance defined by the following claims.

I claim:

1. A training and exercise apparatus for applying force against a resisting force, comprising:

(a) an upstanding frame;

(b) a rotatable arm supported by said frame for unrestricted horizontal rotation about the top of said frame in an arm rotation axis of rotation, when in use;

(c) force receiving means longitudinally slideable along said arm to cause force to be applied against said resisting force when said force receiving means is slid along said arm towards said frame, for receiving force applied by a user;

(d) a resisting force; and (e) connecting means for connecting said force receiving means to said resisting force responsive to the application on said force receiving means to cause force to be applied against said resisting force.

2. An apparatus as described in claim 1 wherein said connecting means is pullable to cause force to be applied against said resisting force.

3. An apparatus as described in claim 2 wherein said connecting means is connected to said force receiving means adjacent to a first end of the connecting means and to said resisting force at a second end of the connecting means and further comprising a second gripping means, connected to said first end of the connecting means, for gripping to cause at first end of said of connecting means to be pulled to apply force on said force receiving means.

4. An apparatus as described in claim 3 wherein said force receiving means includes wheels and said arm includes a longitudinal upper track adopted to receive said wheels for rolling on said track.

5. An apparatus as described in claim 1 wherein said force receiving means includes a first gripping means for gripping to apply force on said force receiving means.

6. An apparatus as described in claim 1 wherein said arm comprises:

(a) a first portion adjacent said first axis of rotation of said arm;

(b) a second portion in longitudinal alignment with said first portion; and (c) connecting means for rotatably connecting said first and second portions for rotation of said second portion with respect to said first portion about arm swivel second axis of rotation in longitudinal alignment with said portions upon application of rotational force on said second portion.

7. An apparatus as described in claim 6, further comprising portion returning means for returning said second portion to a predetermined arm swivel normal position when said rotational force applied on said second portion is released.

8. An apparatus as described in claim 7, wherein said portion returning means is responsive to said resisting force whereby said resisting force causes said second end to return to said arm swivel normal position when said rotational force applied on said arm is released.

9. An apparatus as described in claim 8, further comprising arm swivel securing means for securing said second portion in a fixed position with respect to said first portion in any position about said arm swivel axis.

10. An apparatus as described in claim 8, further comprising arm swivel varying means for varying said arm swivel normal position in any position about said arm swivel access.

11. An apparatus as described in claim 6, wherein said force receiving means further comprises rotating means for rotating said force receiving means with respect to said arm along a force receiving means rotation axis of rotation substantially perpendicular to said arm swivel axis upon application of rotation force on said force receiving means.

12. An apparatus as described in claim 11, further comprising force returning means for returning said force receiving means to a pre-determined force receiving means normal position when said rotational force applied on said force receiving means is released.

13. An apparatus as described in claim 12, wherein said resisting force causes said force receiving means to return to said force receiving means normal position when said rotational force applied on said force receiving means is released.

14. An apparatus as described in claim 13, further comprising force receiving means securing means for securing said force receiving means in a fixed position with respect to said second portion in any position about said force receiving means rotation access.

15. An apparatus as described in claim 13, further comprising force receiving means varying means for varying said force receiving means normal position in any position about said force receiving means rotation access.

16. An apparatus as described in claim 11, further comprising a target removably attached to said force receiving means.

17. An apparatus as described in claim 16, wherein said target comprises an artificial human-shaped dummy.

18. An apparatus as described in claim 1 further comprising arm returning means for returning said arm to a pre-determined arm rotation normal position when rotational force applied on said arm is released.

19. An apparatus as described in claim 18 wherein said resisting forces causes said arm to return to said arm rotation normal position when rotational force applied on said arm is released.

20. An apparatus as described in claim 19, further comprising arm rotation varying means for varying said arm rotation normal position in any position about said arm rotation access.

21. An apparatus as described in claim 1, further comprising treadmill means for providing a movable support surface for the user to move on, said treadmill means comprising a movable upper surface, the speed of movement being responsive to user input whereby said treadmill means is positioned opposite said rotatable arm so the user may apply force against the force receiving means and, simultaneously, be supported by and move with said treadmill means.

22. An apparatus as described in claim 1, further comprising height adjusting means for adjusting the height of said rotatable arm with respect to the frame.

23. An apparatus as described in claim 1, wherein said frame comprises a first frame portion supporting said rotatable arm, a second frame portion supporting the first frame portion and frame adjusting means for adjusting the position of said first frame portion with respect to said second frame portion to adjust the distance between said arm and said second frame portion.

24. An apparatus as described in claim 23, further comprising:

(a) a second arm hingedly connected to said second frame portion and (b) a first pulley means rotatably connected to said arm;

wherein said connecting means is a cable which extends through said pulley means and is connected to said resisting force at one end and wherein said cable is pullable to cause force to be applied against said resisting force.

25. An apparatus as described in claim 1 wherein said resisting force is either a weight, a weight stack, a spring, pneumatic cylinders or a magnetic resistance.

26. An apparatus as described in claim 1, wherein a portion of said connecting means is parallel to and passes substantially through said arm rotation axis.

27. An apparatus as described in claim 26, wherein said arm comprises an opening substantially co-axial with said arm rotation axis through which said connecting means extends.

* * * * *